US012575624B2

(12) United States Patent
Canavan et al.

(10) Patent No.: US 12,575,624 B2
(45) Date of Patent: Mar. 17, 2026

(54) WATERPROOF LOWER LIMB DEVICE, SYSTEMS, AND METHODS

(71) Applicant: Gear Envie Inc., Nantucket, MA (US)

(72) Inventors: Jody Scherrer Canavan, Nantucket, MA (US); Amanda Collins Maugeri, Ossining, NY (US)

(73) Assignee: Gear Envie Inc., Nantucket, MA (US)

( * ) Notice: Subject to any disclaimer, the term of this patent is extended or adjusted under 35 U.S.C. 154(b) by 0 days.

(21) Appl. No.: 19/030,181

(22) Filed: Jan. 17, 2025

(65) Prior Publication Data

US 2025/0295187 A1 Sep. 25, 2025

Related U.S. Application Data

(60) Provisional application No. 63/568,659, filed on Mar. 22, 2024.

(51) Int. Cl.
*A41D 17/00* (2006.01)

(52) U.S. Cl.
CPC ..... *A41D 17/005* (2013.01)

(58) Field of Classification Search
CPC ..... A41D 17/00; A41D 17/005; A41D 17/02; A41D 17/04; A43D 17/00; A43D 17/005; A43D 17/02; A43D 17/04
USPC ..... 36/1.5, 2 R
See application file for complete search history.

(56) References Cited

U.S. PATENT DOCUMENTS

| | | | | |
|---|---|---|---|---|
| 2,145,061 | A * | 1/1939 | Whalen | A43B 3/20 36/2 R |
| 3,238,537 | A * | 3/1966 | Fowler | A41D 13/06 2/242 |
| 4,344,189 | A * | 8/1982 | Futere | A41D 13/08 2/16 |
| 5,170,503 | A * | 12/1992 | Hightower, Jr. | A41D 17/02 2/22 |
| 5,896,676 | A * | 4/1999 | Barousse | A41D 17/02 36/2 R |
| 6,148,544 | A * | 11/2000 | Keen | A43B 23/06 36/129 |
| 9,026,927 | B2 | 5/2015 | Brumback et al. | |
| 2002/0120977 | A1 * | 9/2002 | Smith | A41B 11/00 2/242 |
| 2005/0229328 | A1 | 10/2005 | Tran | |
| 2007/0054577 | A1 | 3/2007 | Avloni | |

(Continued)

*Primary Examiner* — Ted Kavanaugh
(74) *Attorney, Agent, or Firm* — Hamilton, Brook, Smith & Reynolds, P.C.

(57) ABSTRACT

Example embodiments herein relate to a gaiter device configured with a failsafe design that improves the user experience, provides sanitation and increased durability and longevity of the gaiter. Example embodiments include gaiter configurations designed to be worn inside the shoe, which decreases degradation of the gaiter, and further provides enhanced useability, and enhanced durability. The gaiter may be configured with an elastic stirrup to support the gaiter in a shoe, while providing ease of use, sanitation, and flexibility for the user. The gaiter may include a durable lightweight outer film surface resistant to moisture. The gaiter device may be configured as a smart gaiter device, where the elastic stirrup is embedded with sensors and transmitters enabling biometric monitoring and communication of biometrics with smart computing devices.

14 Claims, 9 Drawing Sheets

(56) References Cited

U.S. PATENT DOCUMENTS

| | | | | |
|---|---|---|---|---|
| 2021/0368910 | A1* | 12/2021 | Moller | A61H 23/02 |
| 2023/0276876 | A1* | 9/2023 | Postolek | A41D 17/005 36/2 R |

* cited by examiner

WATERPROOF LOWER LIMB DEVICE, SYSTEMS, AND METHODS

RELATED APPLICATION(S)

This application claims the benefit of U.S. Provisional Application No. 63/568,659, filed on Mar. 22, 2024. The entire teachings of the above application is incorporated herein by reference.

BACKGROUND

Gaiters typically strap over a shoe or boot and may wrap around the person's leg to provide protection from elements from entering the top of the shoe or boot. Gaiters may provide leg and ankle protection against pests, including snake bites.

SUMMARY

Conventional gaiters can be cumbersome. State of the art gaiters provide personal protective equipment featuring the gaiter to be worn over the shoe. As gaiters typically are designed to wear over the shoe, they are not comfortable and can be vulnerable to corrosive elements exposed to the gaiter on the bottom and sides of the shoe/boot. Friction can also cause wear and tear on the gaiter strap under the shoe, particularly during activity. In general, gaiters tend to be impractical for casual use. While hiking is a desirable exercise and a recreational activity, the commercially available gaiters fail to provide additional support to ensure debris is kept out of boots/sneakers. While gaiters exist that attach to socks using a fastening means, they typically cover the boot and can be easily displaced from the fastening means with extensive motion or interference from external elements and friction.

Example embodiments herein relate to a gaiter configured with a failsafe design that improves the user experience, lightweight, as well as provides increased durability and longevity of the gaiter. Example embodiments include gaiter configurations designed to be worn inside the shoe, which decreases degradation of the gaiter, and further provides enhanced useability, and enhanced durability.

An example gaiter according to an embodiment may include:

- a cone shape;
- a shell fabric attached to a lining fabric;
- an insulation material;
- an elastic drawstring;
- an elastic stirrup;
- an arched front opening to accommodate various foot sizes and range of ankle motion, including prosthetics.

In a preferred embodiment, the weight of the gaiter is less than 2.4 ounces.

The example failsafe gaiter elastic drawstring may be adjustable by a cord locking mechanism. In an example, the gaiter is comprised of polyester fabric, insulation material, a proprietary blend of recycled PET and oyster shells, and may be configured with seams sewn with elastic thread to enable stretch. In an example, the gaiter may include a conical shape tapering from larger at the calf to smaller at the ankle.

In an example embodiment, a device is provided, such as a gaiter device, adapted to receive a foot. The example gaiter device may have a cone shape; a shell fabric attached to a lining fabric; an insulation material; an elastic drawstring; an elastic stirrup; and an arched front opening to accommodate a plurality of foot sizes and range of ankle motion.

The elastic drawstring may be adjustable by a cord locking device. The gaiter device may be partially comprised of polyester fabric. The gaiter device may be comprised of insulation material, said insulation material being comprised of recycled PET and oyster shell.

In an embodiment, a smart gaiter device may be provided. The smart gaiter may have a conical shape tapering from larger at a calf of a human to smaller at an ankle of the human. The gaiter device may be comprised of seams sewn with elastic thread to enable stretch. The seams sewn with elastic thread may be comprised of conductive thread and provide elastic quilting lines enabling stretch and electronic communication with at least one smart computing device. The elastic quilting lines may be embedded with at least one communication link comprised of metal fibers, conductive inks, or chromic materials. The elastic stirrup may be embedded with at least one sensor and at least one transmitter enabling biometric monitoring and communication of biometrics with at least one smart computing device. The sensor may be configured to be responsive to biomarkers, environmental conditions or human stimuli. The shell fabric may have an exterior abrasion resistant and waterproof film. The gaiter device may be is compressible by half of a length of the gaiter. The weight of the gaiter may be configured such that it is less than 2.5 ounces. The elastic stirrup may be composed from a composite material of elastane, spandex and wool, and is encased in a low-density polyethylene (LDPE) film.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1:
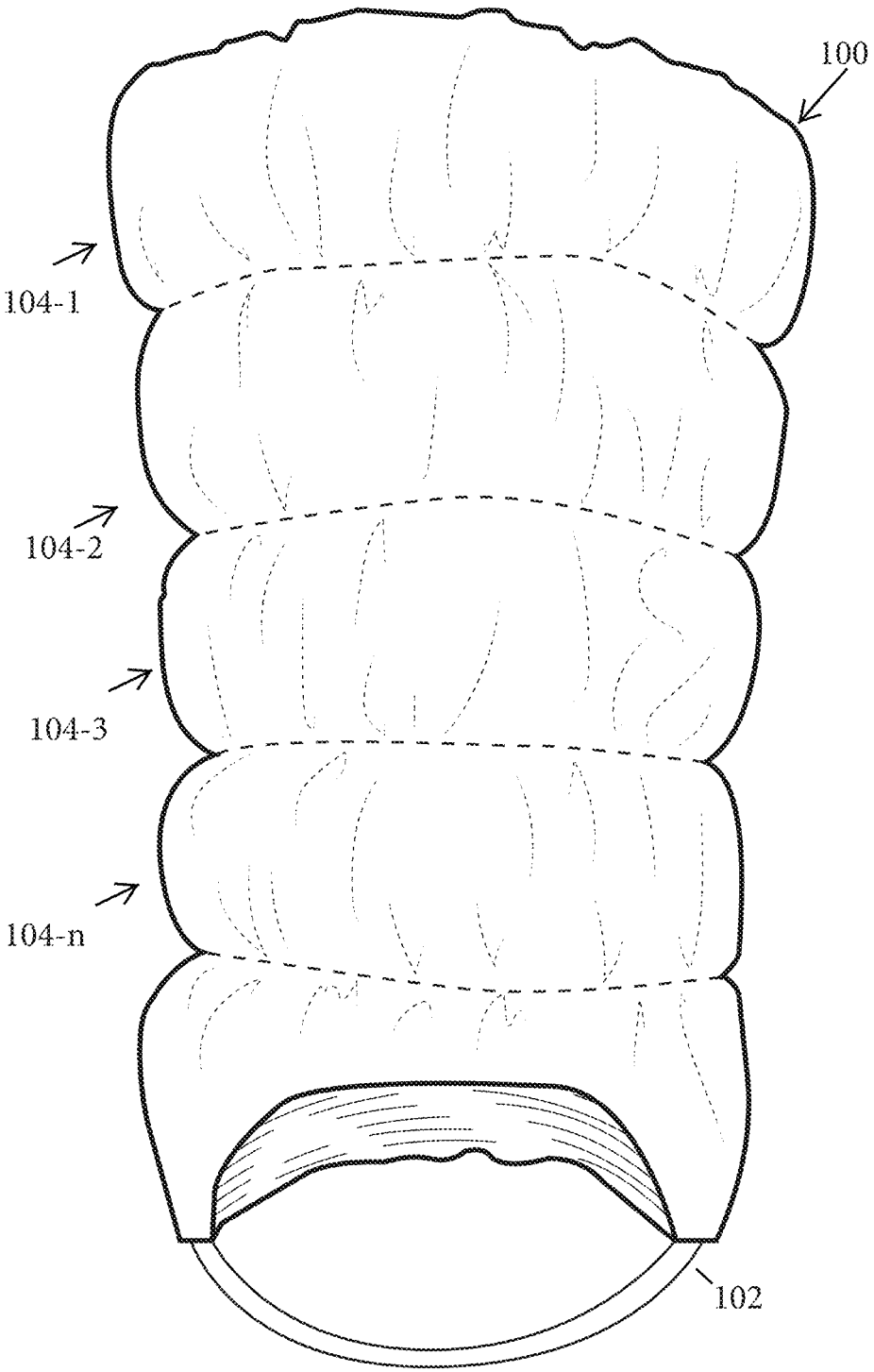
FIG. 1 is a front perspective view of an example embodiment.
Figure 2:
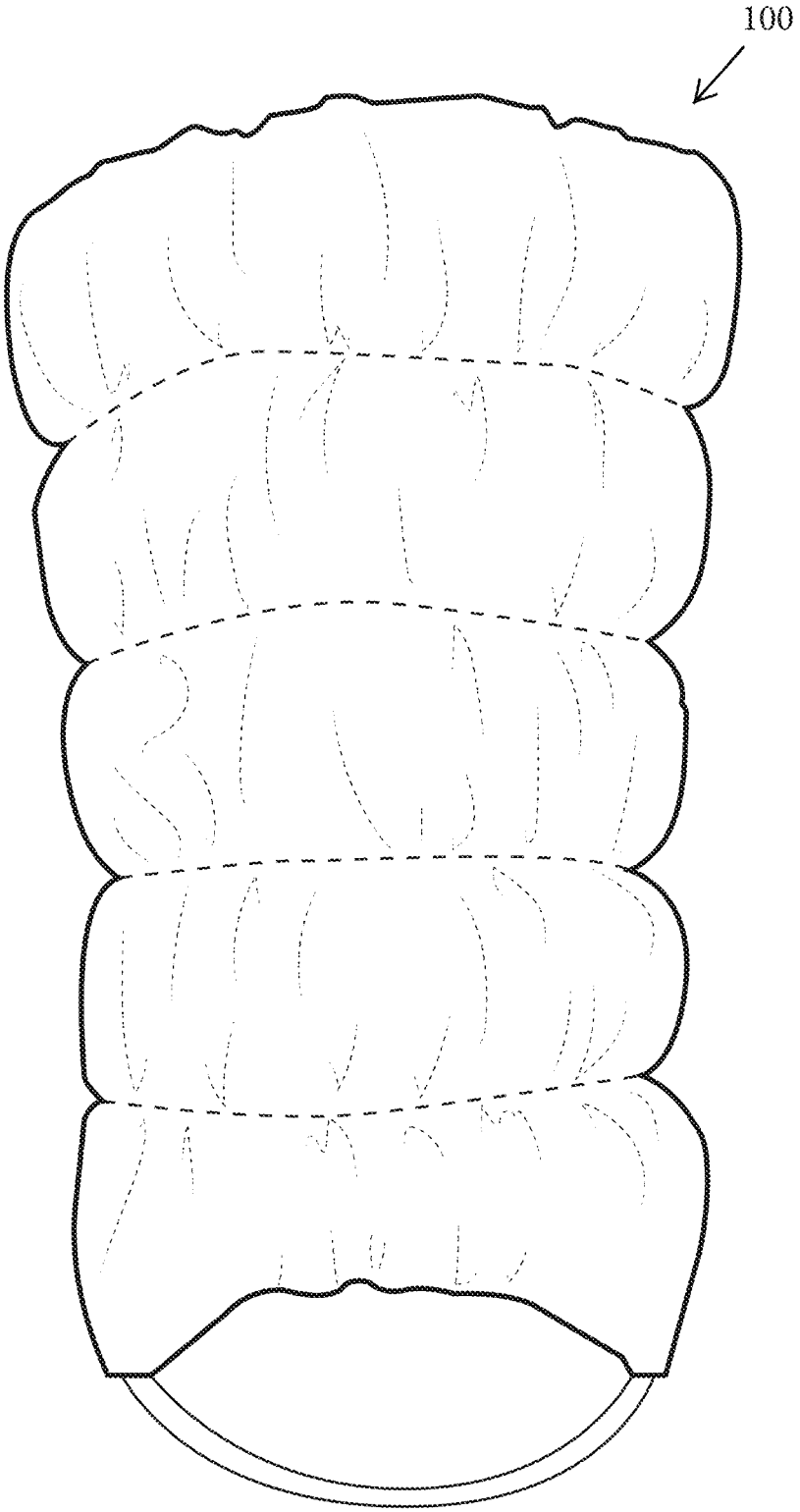
FIG. 2 is a front perspective of a back view of an example embodiment.
Figure 3:
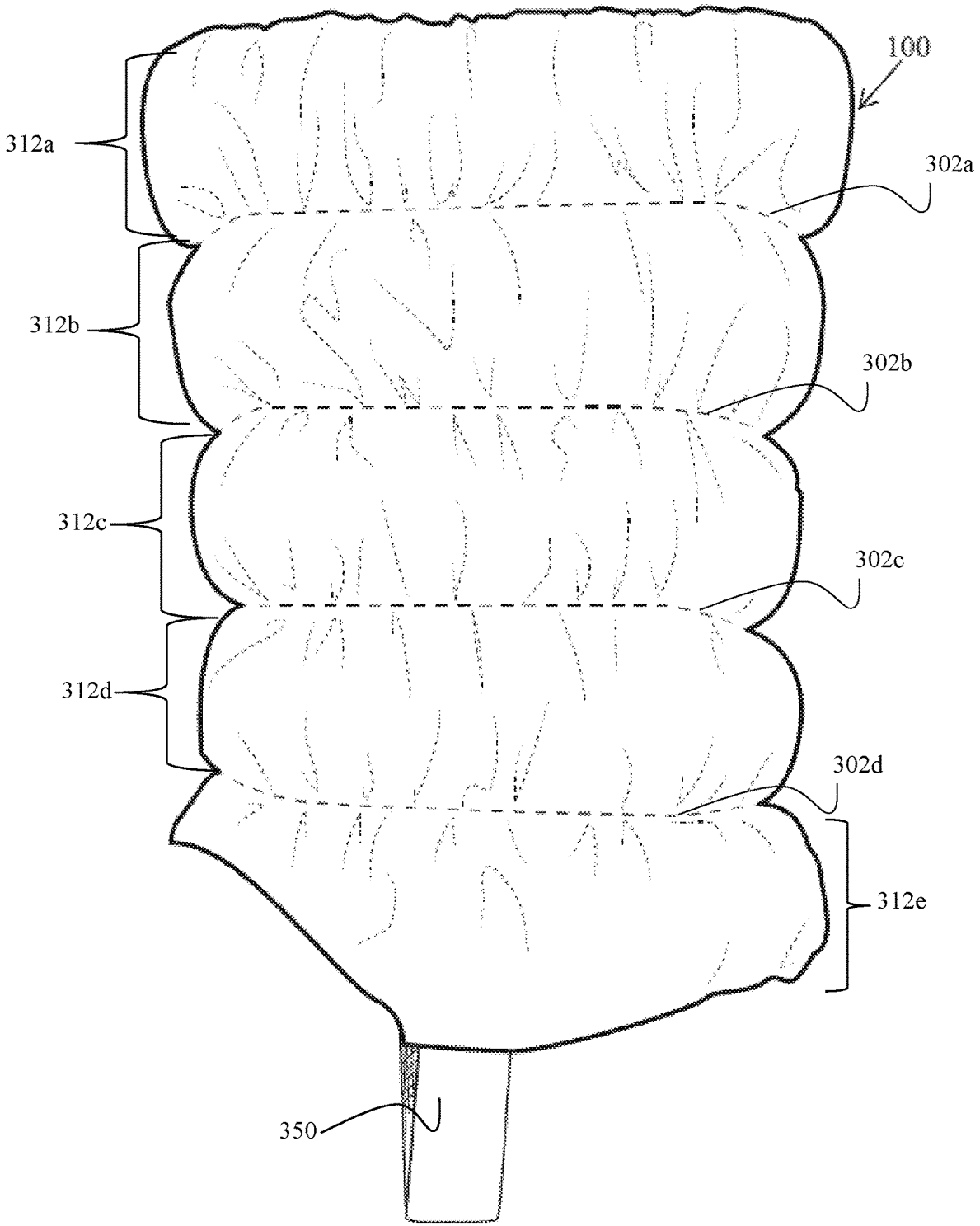
FIG. 3 is a front perspective of a side left view of an example embodiment.
Figure 4:
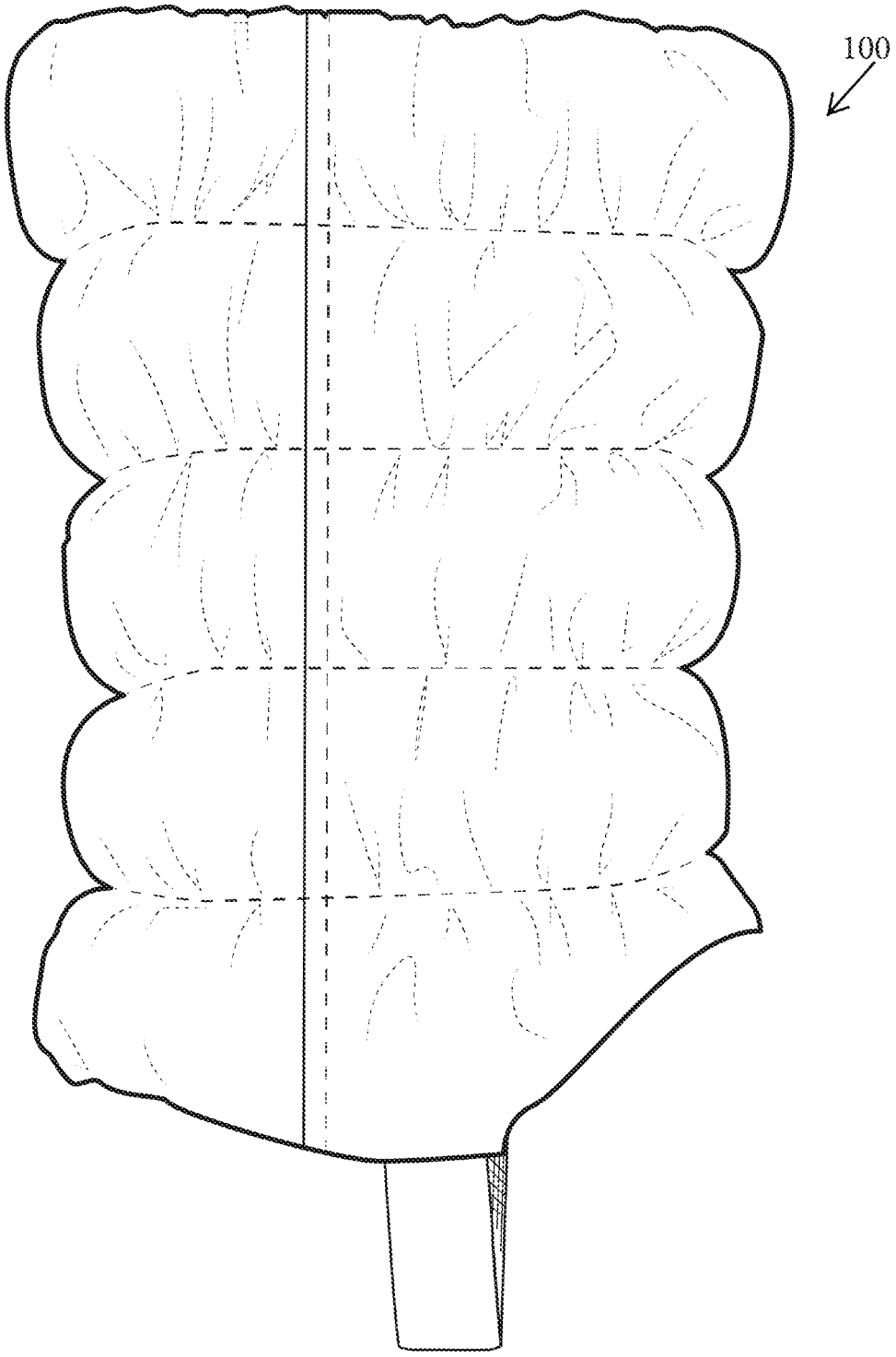
FIG. 4 is a front perspective of a side right view of an example embodiment.

A description of example embodiments follows.

Example embodiments relate to types of protective articles of apparel for a person's ankles and legs below the knee. An example implementation serves as a gaiter type of device that may be worn, such as when walking, hiking, running outdoors amongst dense underbrush or in snow.

FIGS. 1-8 show an example gaiter device 100 according to an embodiment. Preferably, the gaiter device 100 has at least four baffles 104-1, 104-2, 104-3, **104-*n*** according to an embodiment.

The example gaiter 100 may include a cone shape having a shell fabric attached to a lining fabric. In an example, an insulation material **312*a*, 312*b*, 312*c*, 312*d*, and 312*e* inside the shell fabric and lining fabric may be used. An elastic drawstring 110 may be used to enable tightening of the gaiter 100. The gaiter may be configured with elastic stirrup 102, which can be designed to support the gaiter around a foot inside a shoe. The elastic stirrup 102** may be flexible enough to enable the insulation material expandable to the any height of the shoe/boot opening.

The elastic stirrup to enables ease of use for the user, as it is configured with a flexible compound that embraces all foot widths and heights, while provides enhanced sanitation, and flexibility for the user. By using an elastic stirrup, the gaiter is able to accommodate a prosthetic foot/leg. The elastic strip enables the gaiter to be adaptive for amputees providing high-performance fibers and moisture-wicking technology, as discussed in the example materials below.

For example, in an embodiment, the elastic stirrup may be composed from graphene, a two-dimensional carbon material that provides enhanced elasticity, tensile strength and strength. It is lightweight, made from graphite, which is a natural substance made up of graphene sheets. In an embodiment, the stirrup may be composed from low-density polyethylene (LDPE), which is a lightweight thermoplastic that is flexible, durable, and impact resistant. Graphene and/or LDPE can enable the elastic stirrup to be easily adaptable for prosthetics for amputees.

In an embodiment, the elastic stirrup may be composed from neoprene rubber, which is a lightweight thermoplastic that's flexible, durable, and impact resistant.

In another embodiment, the stirrup may be composed from textile fabrics, such as elastane, spandex, mesh, wool, viscose jacquard, and tulle.

In an example preferred embodiment, the stirrup may be composed from a composite material of elastane, spandex and wool, encased in a low-density polyethylene (LDPE) film, which enables the stirrup to provide resistance to moisture, while providing enhanced elasticity and tensile strength.

As discussed herein, the elastic stirrup may be embedded with sensors 350 and transmitters enabling biometric monitoring and communication of biometrics with smart computing devices. The location of the stirrup having contact with the arched surface of the foot between the toes and ankle, provides a good blood perfusion and a high density of capillary vasculature enabling an optimal place to measure biometrics, particularly during physical activity.

The gaiter may include a durable lightweight outer film surface resistant to moisture.

Figure 5:
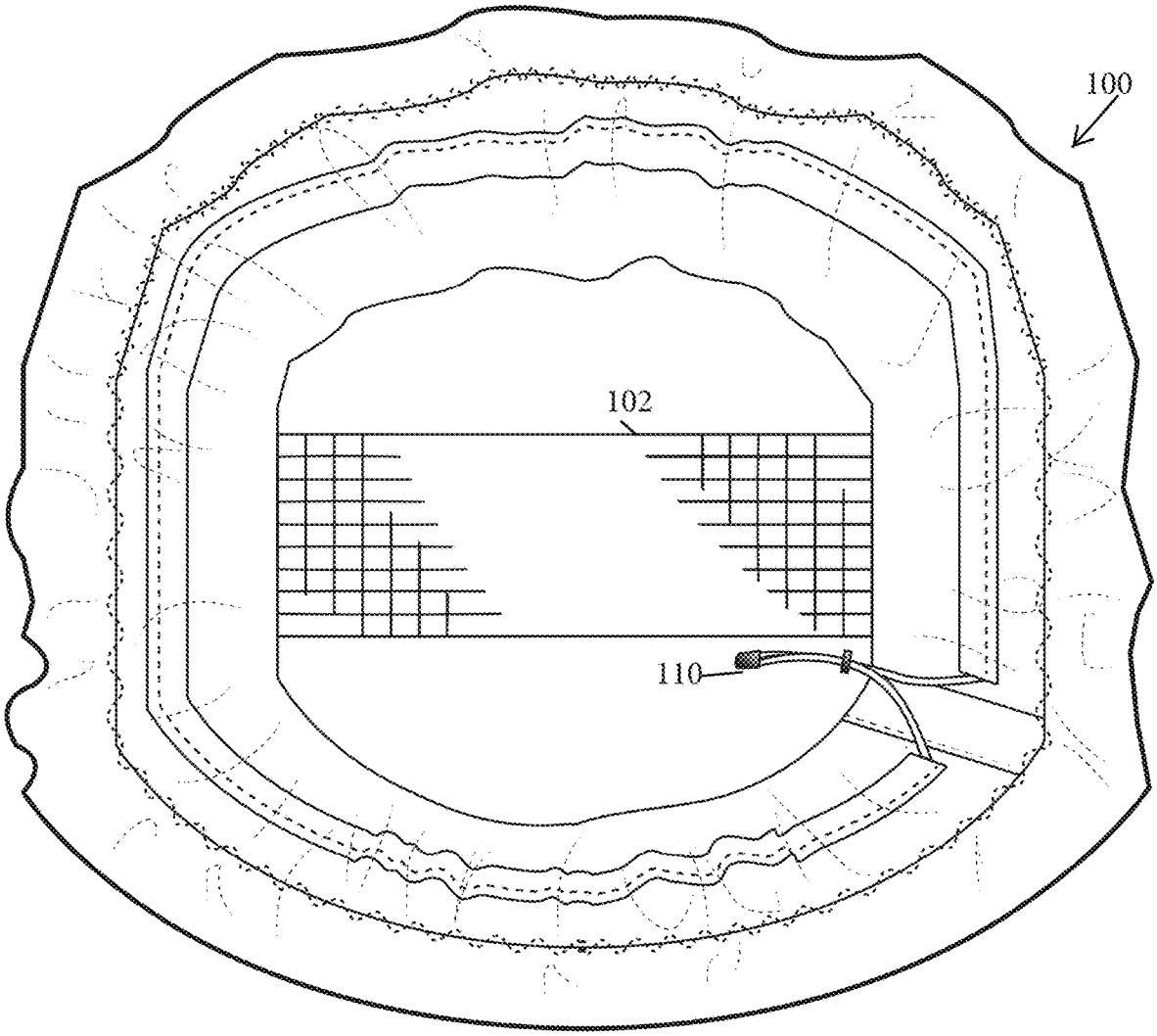
FIG. 5 is a front perspective of a top view of an example embodiment.
Figure 6:
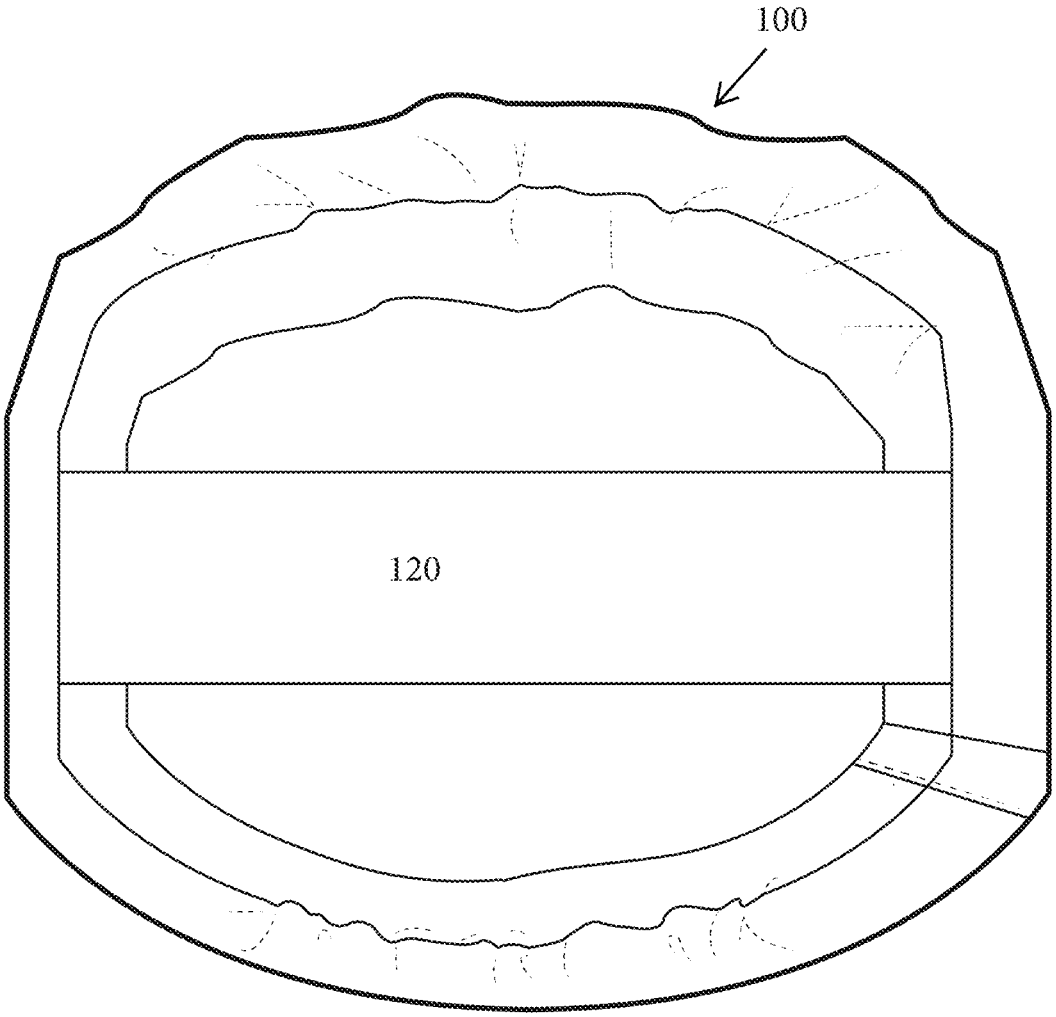
FIG. 6 is a front perspective of a bottom view of an example embodiment.
Figure 7:
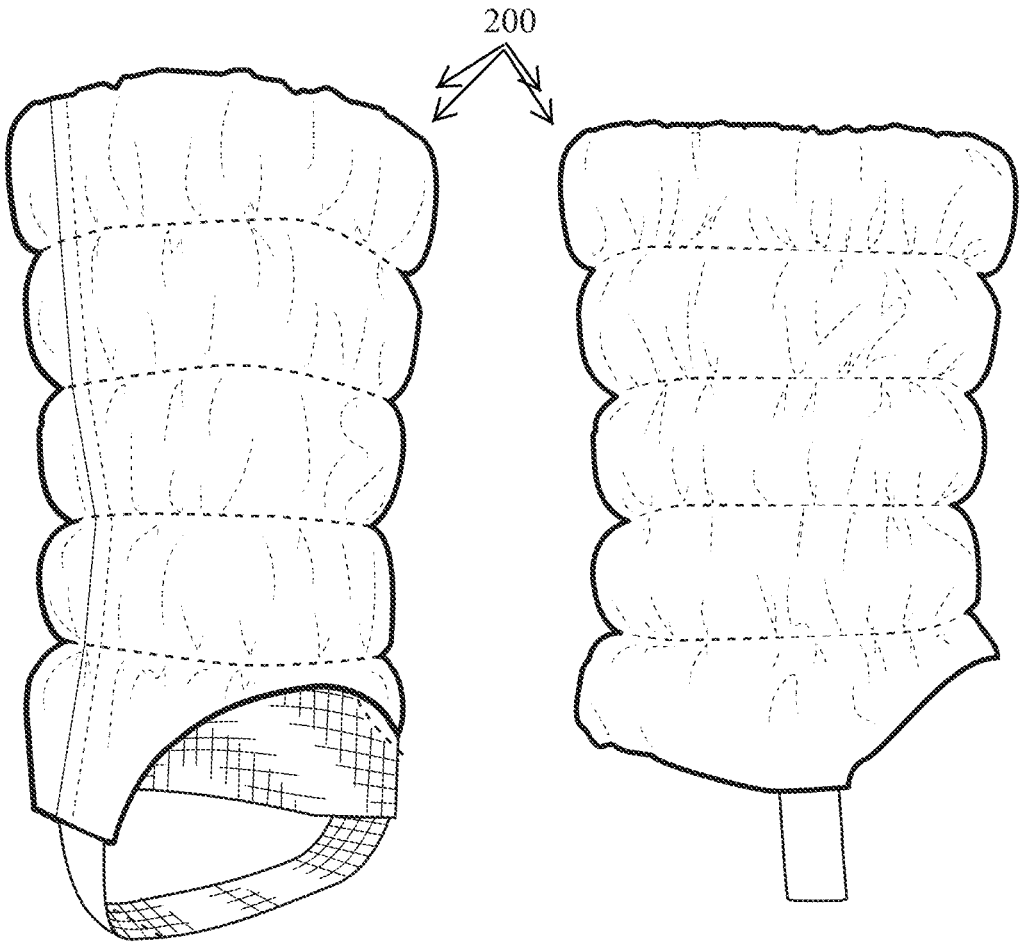
FIG. 7 is a front perspective of a ¾ view of an example embodiment.
Figure 8:
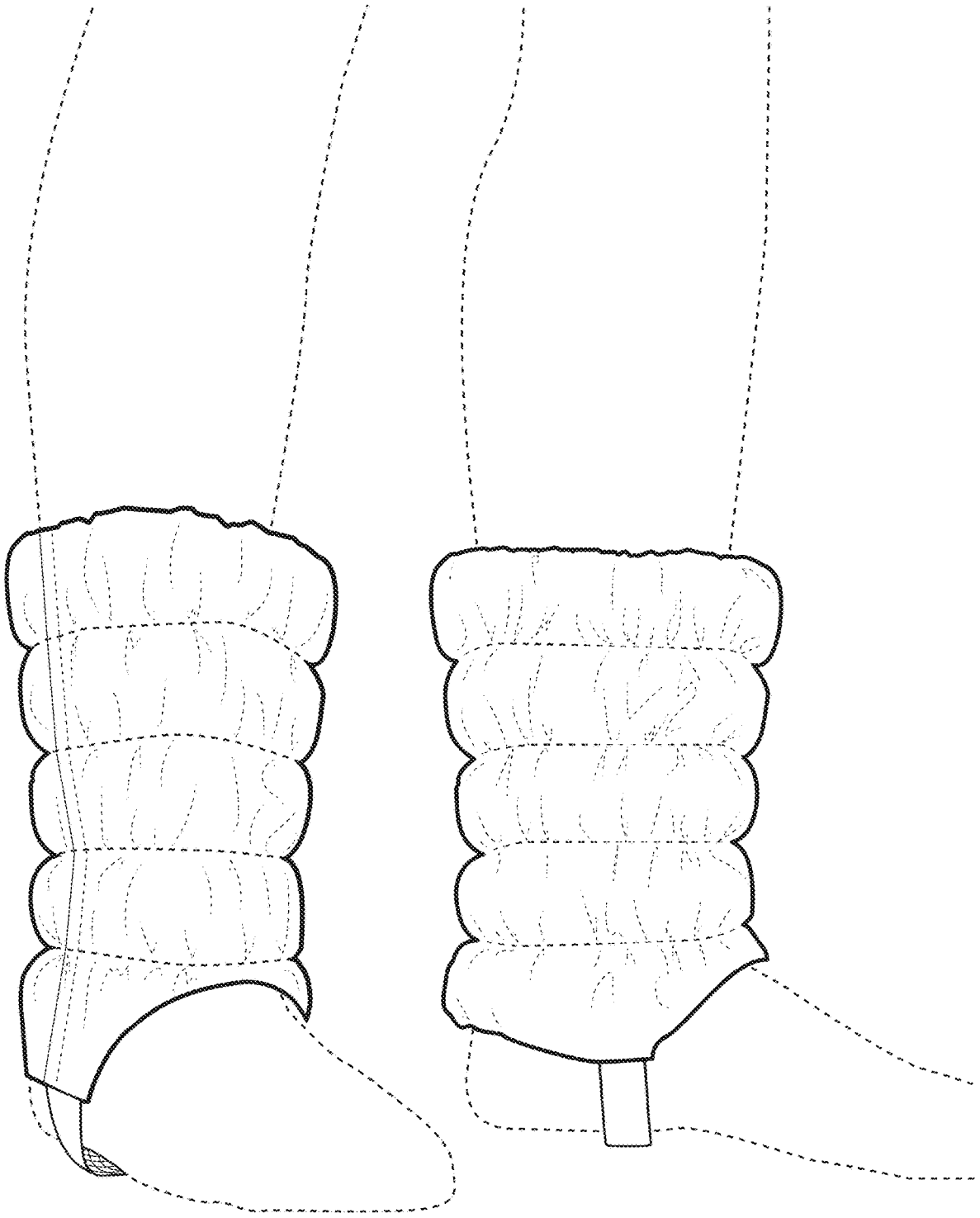
FIG. 8 is a front perspective of a ¾ (incl. Leg for scale) view of an example embodiment.
Figure 9:
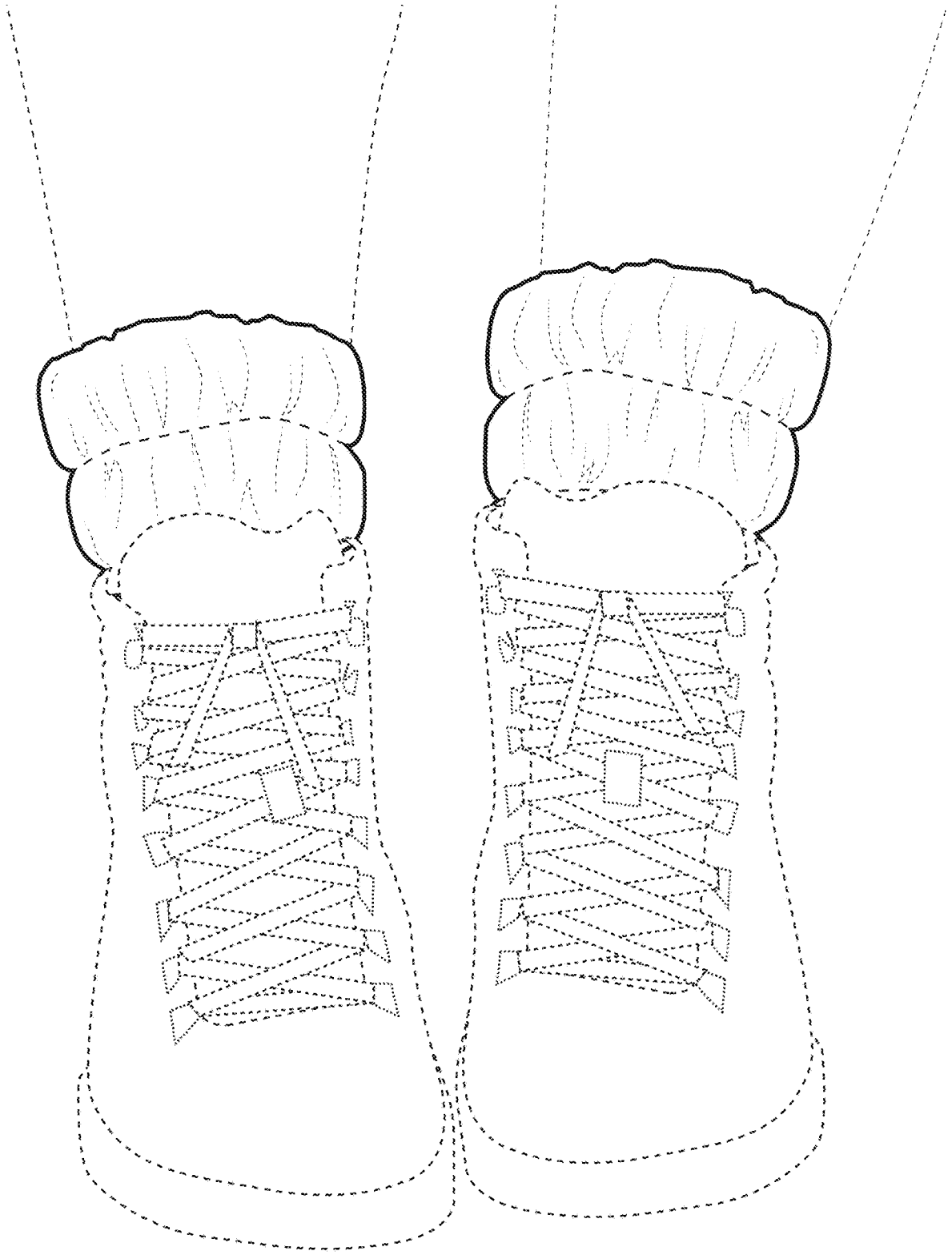
FIG. 9 is a front perspective of an example embodiment while being worn with a hiking boot.

In one example, an arched front opening at the top of the gaiter 100 may be configured to accommodate various foot sizes and range of ankle, see e.g. top view at FIG. 5.

The gaiter is configured to be worn inside the shoe. The gaiter is configured with a quilted and insulated design, which is comfortable, easy to operate, for everyday use.

In an example preferred embodiment, the gaiter is configured with an eco-friendly material; 100% recycled, downproof polyester, durable enough to withstand wear and tear. Insulation material may be created using recycled PET (water bottles) and oyster shells. The insulation preferably is anti-static, anti-bacterial, anti-odor, quick-dry, breathable and is a more effective insulator than polyester insulation.

Lightweight material and insulation can enhance the user experience ensuring the gaiter is comfortable and breathable for the user. The lightweight gaiter fabric design may be configured to create the impression for the the user to barely feels like he/she is wearing anything at all.

In a preferred embodiment, the gaiter is compressible to approximately ⅕ of its original size to make packing easy.

In an embodiment, the elastic stirrup may be configured to ensure the gaiter device is held in place, preventing it from riding up leg during use. Elastic drawstring keeps the gaiter device in place and prevents debris from entering the top of the gaiter in between the pant leg and the gaiter.

The gaiter may be configured with elastic quilting lines **302*a*, 302*b*, 302*c*, 302*d* to enable stretch and comfort. The gaiter can be configured to sit fitted against the body, but also can stretch to accommodate a wide variety of sizes of wearers. In an embodiment, the stirrup of the gaiter or the elastic quilting lines 302*a*, 302*b*, 302*c*, 302*d* may be configured from smart textiles configured to enable interaction, communication and sensing. The textiles may include embedded metal fibers, conductive inks, chromic materials, coating with nanoparticles, sensors 350** and transmitters enabling biometric monitoring and communication with smart devices. Example biometric monitoring devices and smart devices are disclosed in U.S. Pat. No. 10,327,674B2, and "Biometric monitoring device with immersion sensor and swim stroke detection and related methods", filed 2017 May 22, U.S. Pat. No. 9,026,927B2, "Biometric monitoring device with contextually- or environmentally-dependent display", filed 2013 Oct. 3 the entire teachings of which are incorporated by reference in their entirety.

Example modes of operation for the gaiter 100 may include: (1) Step one, put on socks, (2) Step two, put on the gaiter, (3) Step three, put on shoes, (4) Step 4 check to make sure the gaiter is inside the shoe and that there are no obvious gaps between the shoe and the gaiter. An optional step-adjust the top elastic to desired fit to ensure no debris is able to enter from the top between pant/leg and proceed to hiking, snow shoeing, trail running, etc.

Alternative Embodiments include a knee-high gaiter, ankle high gaiter, thigh high gaiter, heavy duty gaiter, rain/wet gaiter, more complex gaiter (e.g. zipper opening), or reflective gaiter.

In an embodiment, the gaiter may be comprised of a combination of the following material/fabrications: Gore-Tex, Nylon Ripstop (PU or Silicone), Polyester Taffeta, Nylon, Polyurethane Coated Fabrics (PU), Polyvinyl Chloride (PVC), Wax Cotton, Fur/Leather, Expanded Polytetrafluoroethylene Membrane (E-PTFE), Sustainable and Eco-Friendly Textiles, Recycled Material, Organic Fiber, Biodegradable Material, 3D Printed Textiles, Conductive Textiles, Smart Textiles.

In an example preferred embodiment, the gaiter may be configured with a computational device configured to monitor biometrics and track and analyze body movements, monitor performance metrics, provide real-time feedback, safety and protection, GPS tracking, SOS monitoring links with fall detection, hydration monitor with feedback. The computational device may be embedded a microprocessor in the gaiter. In one example, the microprocessor is embedded in the stirrup. Preferably, the microprocessor is nanotechnology in textiles. One such example is in US20050229328A1, "Nano-particles on fabric or textile", filed 2005 Feb. 23, US20070054577A1, "Electroconductive woven and non-woven fabric and method of manufacturing thereof", published 2007 Mar. 8, the entire teachings of which are incorporated herein by reference in its entirety. By embedding a microprocessor or nano-particles and sensors 350 into the gaiter, directly into the fabric, the gaiter device allows the clothing to perform functions like monitoring vital signs, adjusting temperature, or even interacting with other devices; essentially making the gaiter "smart" by integrating technology into its structure. Such electronics, including nanoparticles and nanofibers incorporated into the gaiter can provide enhanced functionality, metrics and biomarker monitoring capabilities for the user.

Preferably the gaiter is configured to repel water, stain resistance, UV protection, and insect repellent fabric treatment. The gaiter may include chemical compound repellents, permethrin, DEET, or natural repellents, essential oils (e.g. lemon, eucalyptus, and cedar).

The gaiter device may be configured with wearable technology, such as heating elements, cooling elements, GPS, sensors 350 for step monitoring, Bluetooth ability to pair with smart devices. The gaiter device may be configured with functional details, such as visibility and safety reflective panels. The gaiter may include features to enable gaiters to be fastened together for travel or transport. The gaiter may be configured with a pocket for key/air tag. The gaiter may be configured with a skirting piece or extra protective barrier for additional protective layer, and accommodations for foot/leg prosthetics.

The gaiter may be confirmed with several optional design embodiments. For example, quilting baffle height (space between quilting lines) total height can vary. The width may be adjustable to accommodate additional sizes of humans. Knee high versions of the gaiter may be configured having more than five baffles. In an example preferred embodiment, an adjustable height configuration may be provided. For example, elastic material may be incorporated between the baffles to ensure flexibility of height. In another embodiment, a thigh high gaiter may be provided to provide enhanced leg protection including thigh protection.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A device comprising:

a gaiter adapted to receive a foot, the gaiter having:

a top;

a bottom;

a conical shape that tapers from a larger entry opening at the top of the gaiter to a smaller opening at the bottom of the gaiter;

an exterior shell fabric configured to repel water;

an interior lining fabric;

an insulation material inside the exterior shell fabric and the interior lining fabric;

a plurality of quilted baffles filled with the insulation material, wherein the plurality of quilted baffles are configured with elastic thread to ensure flexibility of width of a calf;

an elastic drawstring at the larger entry opening at the top of the gaiter, the elastic drawstring adjustable by a cord locking device;

an elastic stirrup at the smaller opening at the bottom of the gaiter; and the elastic stirrup having an arched front opening to accommodate a plurality of foot sizes and range of ankle motion.

2. The device as in claim 1 wherein said exterior shell fabric of the gaiter is comprised of polyester fabric.

3. The device as in claim 1 wherein said plurality of quilted baffles filled with the insulation material further includes said insulation material being comprised of recycled water bottles and oyster shell.

4. The device as in claim 1 wherein the conical shape that tapers from a larger entry opening at the top of the gaiter to a smaller opening at the bottom of the gaiter further includes said the larger entry of the gaiter opening wrapping around a calf of a human and the smaller opening at the bottom of the gaiter wrapping around an ankle of the human.

5. The device as in claim 1 wherein the elastic thread are configured of seams sewn with elastic thread to enable stretch.

6. The device as in claim 5 wherein the seams sewn with the elastic thread include conductive thread in elastic quilting lines enabling stretch and electronic communication with at least one sensor.

7. The device as in claim 6, wherein the conductive thread and elastic quilting lines are embedded with at least one communication link comprised of metal fibers, conductive inks, or chromic materials.

8. The device as in claim 6, wherein the elastic stirrup is embedded with at least one sensor and at least one transmitter enabling biometric monitoring and communication of biometrics with at least one sensor.

9. The device as in claim 7, wherein the sensor is configured to be responsive to biomarkers, environmental conditions or human stimuli.

10. The device as in claim 1 wherein the exterior shell fabric is exterior abrasion resistant and waterproof film.

11. The device as in claim 1 wherein the gaiter is compressible by half of a length of the gaiter to enabling packing.

12. The device as in claim 1 wherein a weight of the gaiter is less than 2.5 ounces.

13. The device as in claim 1 wherein the elastic stirrup is composed from a composite material of elastane, spandex and wool, and is encased in a low-density polyethylene (LDPE) film.

14. The device as in claim 11 wherein the plurality of quilted baffles are configured with elastic thread to ensure flexibility to ensure flexibility of height of the gaiter.

* * * * *